US005757323A

United States Patent [19]

Spencer

[11] Patent Number: 5,757,323

[45] Date of Patent: May 26, 1998

[54] ANTENNA ARRANGEMENTS

[75] Inventor: David G. Spencer, Lincoln, United Kingdom

[73] Assignee: Plessey Semiconductors Limited, United Kingdom

[21] Appl. No.: 682,990

[22] Filed: Jul. 16, 1996

[30] Foreign Application Priority Data

Jul. 17, 1995 [GB] United Kingdom ..... 9514557
Feb. 16, 1996 [GB] United Kingdom ..... 9603320

[51] Int. Cl.[6] ..... H01Q 1/38

[52] U.S. Cl. ..... 343/700 MS; 343/767; 343/785; 343/909

[58] Field of Search ..... 363/700 MS, 767, 363/770, 785, 909, 911 R, 781 CA, 781 R

[56] References Cited

U.S. PATENT DOCUMENTS 3,611,392 10/1971 Knox ..... 343/755
4,673,945 6/1987 Syrigos ..... 343/785
4,673,947 6/1987 Newham ..... 343/785
4,755,820 7/1988 Backhouse et al. ..... 343/700 MS
5,041,840 8/1991 Cipolla et al. ..... 343/786
5,185,613 2/1993 Whatmore et al. ..... 343/911 R
5,248,987 9/1993 Lee ..... 343/785
5,448,252 9/1995 Ali et al. ..... 343/700 MS
5,550,553 8/1996 Yamaki et al. ..... 343/785

FOREIGN PATENT DOCUMENTS 2 268 626 1/1994 United Kingdom .

*Primary Examiner*—Donald T. Hajec
*Assistant Examiner*—Tan Ho
*Attorney, Agent, or Firm*—Kirschstein, et al.

[57] ABSTRACT

A microstrip patch or slot radiating element is coupled to a dielectric rod antenna by way of a tapered tubular dielectric guide formed integrally with the rod. An array of radiating elements may be formed on a common substrate, and the dielectric guide/rod antennae may be arranged to direct the energy radiated from these elements to a secondary antenna element such as a lens or a dish.

15 Claims, 3 Drawing Sheets

ANTENNA ARRANGEMENTS

BACKGROUND OF THE INVENTION

The present invention relates to antenna arrangements utilising dielectric rods, and particularly although not exclusively to such antenna arrangements for use with microstrip, stripline, patch or slot radiating elements.

The efficiency of a microstrip or stripline planar patch or slot radiating element is relatively low when operating at frequencies of the order of 20 GHz or higher, because of the microstrip feed line losses. The half-power beam width (HPBW) of a radiating patch is typically 130–180 degrees, and a single patch radiating element cannot efficiently feed, or illuminate, an antenna element such as a dielectric lens, a Fresnel lens or a reflector dish.

SUMMARY OF THE INVENTION

In accordance with one aspect of the present invention in an antenna arrangement utilising a dielectric rod, a patch or a slot radiating element is coupled to said dielectric rod by means of a tapered tubular dielectric guide.

The dielectric guide may be formed integrally with the dielectric rod, and the patch, the guide and the dielectric rod may be of circular, square, rectangular, elliptical or polygonal section.

The integrally formed dielectric guide and dielectric rod, hereinafter referred to as a dielectric guide rod or guide rod, may be supported over the radiating element by means of a screen panel, which panel may be constructed as a microwave absorbing panel, a half-wave radome panel, a meniscus lens, or a combination of these constructions. In order to minimise its effect on the voltage standing wave ratio (VSWR) of the radiating element, the screen panel may be spaced from the radiating element by half a wavelength at the centre frequency of operation, or in the case of the meniscus lens, the internal radius of the lens may be an integral number of half wavelengths. An alternative arrangement for supporting the dielectric guide rod may comprise dual dielectric panels separated by a half wavelength, the two panels having similar dielectric constants and electrical thicknesses, which thicknesses may be greater than or preferably less than a half wavelength.

The dielectric guide rod may be provided along part of its length with an external thread by means of which it may be located with respect to the screen panel so that the gap between the dielectric guide end and the patch radiating element may be adjusted to optimise the coupling between the patch and the guide rod. The optimum gap may be of the order of 3% of a wavelength.

An array of patch radiating elements may be formed on a common substrate, and each may be provided with a respective dielectric guide rod supported by means of a common screen panel.

BRIEF DESCRIPTION OF THE DRAWINGS

Antenna arrangements in accordance with the present invention will now be described by way of example with reference to the accompanying drawings, of which.

DETAILED DESCRIPTION OF THE PREFERRED EMBODIMENTS

Figure 1A:
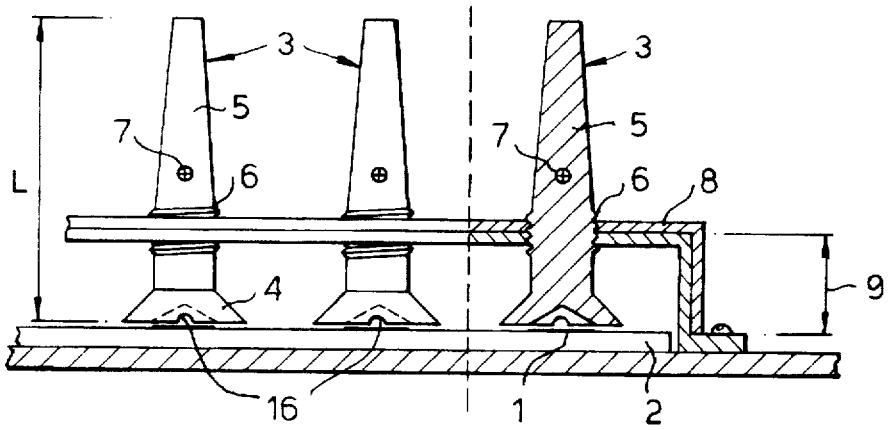
FIGS. 1(*a*) 1(*b*), 1(*c*) and 1(*d*) show diagrammatically in part-section four different forms of antenna arrangement, FIGS. 2(*a*), 2(*b*), 2(*c*) and 2(*d*) show diagrammatically four different forms of feed arrangement for a patch radiating element for use in the antenna arrangements of FIGS. 1(*a*) to 1(*c*)
Figure 1B:
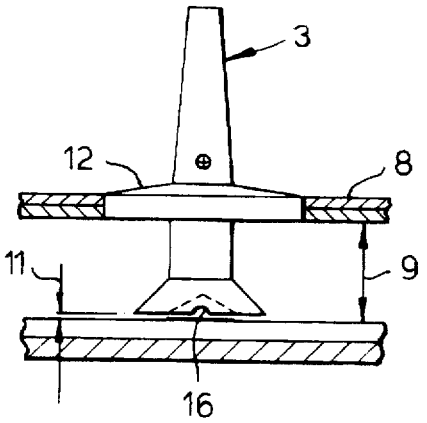
Figure 1C:
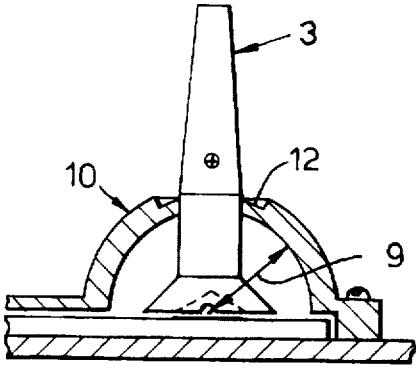
Figure 1D:
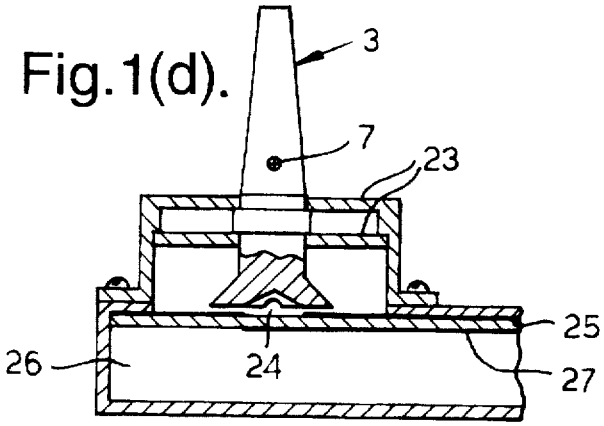
Figure 2A:
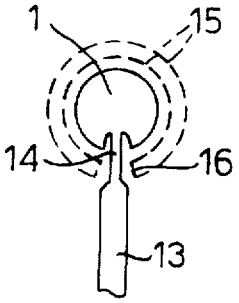
Figure 2B:
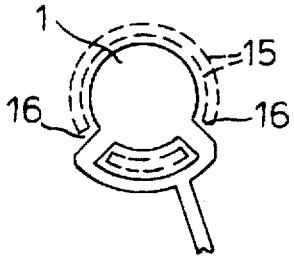
Figure 2C:
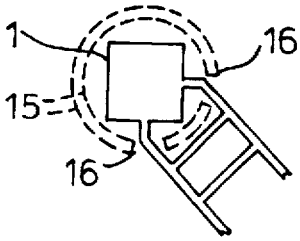
Figure 2D:
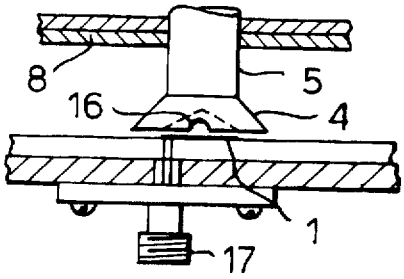

Referring first to FIG. 1(*a*) one form of antenna arrangement in accordance with the present invention comprises an array of patch radiating elements 1 formed on a dielectric substrate 2, each patch 1 having supported over it a respective dielectric guide rod 3. The dielectric guide rods 3 each comprise a tubular tapered or conical section 4 adjacent the respective patch 1 and a tapered dielectric rod section 5, which may be of the form sometimes referred to as a polyrod or a ferrod, depending on the material. Each guide rod 3 is provided with an external thread 6 over part of its length below its phase centre 7 by which it is adjustably mounted in a correspondingly threaded hole in an absorbing screen panel 8, which may be constructed as a dual microwave absorbent panel, as indicated in FIG. 1(*a*), with a half-wave radio-transparent radome panel 12, as indicated in FIG. 1(*b*) or as a meniscus lens 10, as indicated in FIG. 1(*c*), or as a combination of such structures.

In order to minimise the voltage standing wave ratio (VSWR) of the patch radiator 1 the clearance or spacing 9 between the screen panel 8 and the substrate 2, or the internal radius of the lens 10, is made substantially equal to a half wavelength at the centre frequency of operation, although the optimum dimension may be influenced by cross-coupling to adjacent patches 1 resulting from internal reflections from the under surface of the screen panel 8. For this reason the dielectric constant and the corresponding refractive index of the material of the panel 8 should be relatively low, typically less than 1.8.

If the screen panel and the dielectric guide rods 3 are formed of the same material, for example of a thermoplastic low loss polymer, the spacing 11 (FIG. 1(*b*)) between the lower face of the conical section 4 of a guide rod 3 and the respective patch 1, once adjusted for optimum coupling by means of the respective threaded portion 7, will be largely compensated against ambient temperature changes. If required the screen panel 8 and the dielectric guide rods 3 could be moulded as a single assembly. The actual spacing 11 may be of the order of 3% of a wavelength. The manner of supporting the guide rods 3 in position avoids the use of structural adhesive, which adhesive could contribute to feeder losses. The coupling adjustment may be used to equalise beam steering losses for an array of patches 1.

Alternatively, as shown in FIG. 1(*d*), the guide rods 3 may be supported by dual planar dielectric panels 23, which have an electrical thickness of less than a half wavelength at the centre frequency of operation and which are separated by a half wavelength. The radiating element 24 in this illustration is shown as a radiating microstrip slot or annulus, formed on a microstrip substrate 25 and fed by a microstrip or stripline 27. The substrate 25 may be suspended over a cavity 26 a quarter wavelength deep.

The optimum internal cone angle of the section 4 may be determined empirically. If the dielectric constants of the materials of the guide rods 3 and the substrate 2 or 25 are low, for example less than 1.8, the cone angle would typically be 120°, whereas if the substrate dielectric constant is higher a larger cone angle may be used.

A guide rod 3 of a material with a high dielectric constant, such as a ferrite, can be coupled to a patch radiator 1 without seriously perturbing the patch resonant frequency or VSWR, while guide rods of materials having similar dielectric constants to that of the substrate 2 have minimal effect upon the resonant frequency.

Referring now to FIGS. 2(*a*) to 2(*d*) the patch radiating element 1 may be fed by way of a stripline 13 and an impedance transforming section 14, as shown in FIG. 2(*a*), the adjacent or lower face of the associated dielectric guide section 4 being indicated by the concentric dashed circles 15. The impedance transforming section 14 is almost unaffected by the presence of the dielectric guide rod 3 if a small side aperture 16 is provided over the feed line. Alternatively, by rotating the rod 3 a form of dielectric tuning can be applied to the feed line for adjustment or optimisation of the VSWR and/or the phasing.

For dual-feed patches, for dual polarisation or circular polarisation as shown in FIGS. 2(*b*) and 2(*c*) respectively, the dielectric guide section 4 can be provided with two apertures 16 at the feed line positions. Alternatively, by arranging an asymmetry between the apertures 16 and the feed lines, dielectric tuning of the cross-polar isolation can be achieved by rotating the rod 3. Both the guide-to-rod transition and the screen panel 8 provide isolation between the radiating discontinuities of the microstrip feed lines 13 and the output of the antenna arrangement, thereby improving the cross-polar isolation and the side and back lobes of the arrangement.

The patch radiator 1 may be back-fed by an orthogonal probe from a coaxial line 17, as shown in FIG. 2(*d*), but this is limited to lower frequencies, typically less than 20 GHz, since the coaxial line diameter should be less than the patch diameter.

Figure 3:
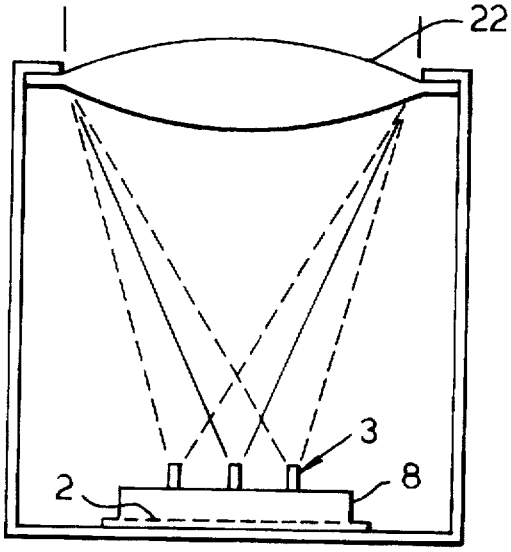
FIG. 3 shows diagrammatically a beam-steering antenna arrangement, FIG. 4 show diagrammatically a polarised antenna arrangement.

The boresight direction of a dielectric guide rod 3 may be varied over a limited range of angles by introducing a bend in the rod section 5, as shown in FIG. 3. Preferably the bend radius should be not less than four wavelengths.

Figure 4:
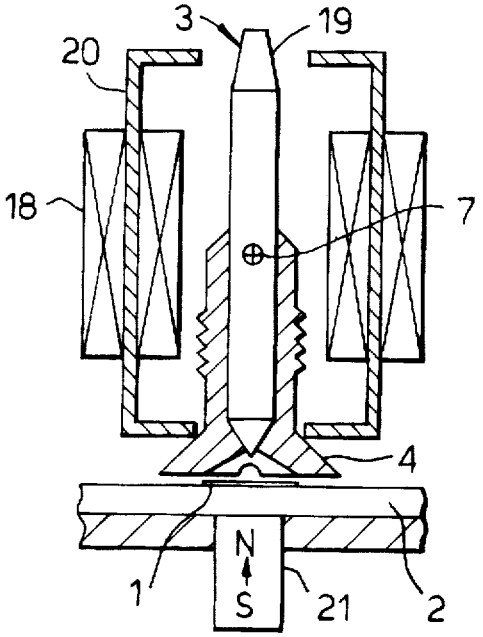

In the polarisation configuration of FIG. 4 a coil 18 is wound around the ferrite element 19 of the guide rod 3 on a magnetic yoke 20, and a permanent magnet 21 is fixed under the substrate 2. The axial length of the coil 18 will depend on the phase centre position of the guide rod 3. Because of the large applied fields required at millimetric frequencies, a bipolar (dual polarity) biasing technique will be preferred.

Where an antenna arrangement such as that shown in FIG. 1(*a*) is utilised as a feed system for an apertured element such as the dielectric lens 22 shown in FIG. 3, the microstrip/guide rod assembly enables the aperture edge illumination taper to be controlled by selection of the rod length L, FIG. 1(*a*), and sectional shape of the guide rods 3. Hence the side-lobes, half-power beam-width and gain of the overall antenna system can be optimised for a specific aperture focus-to-diameter ratio. In the particular application of beam steering shown, the half-power beam-widths and steering losses of the off-axis feeds can be independently optimised relative to the on-axis feed. For example, the guide rod length of the on-axis feed could be slightly longer or the rod diameter slightly larger, so that the greater edge illumination of the on-axis feed equalises the half-power beam-widths and the on and off-axis aperture gains.

Figure 5:
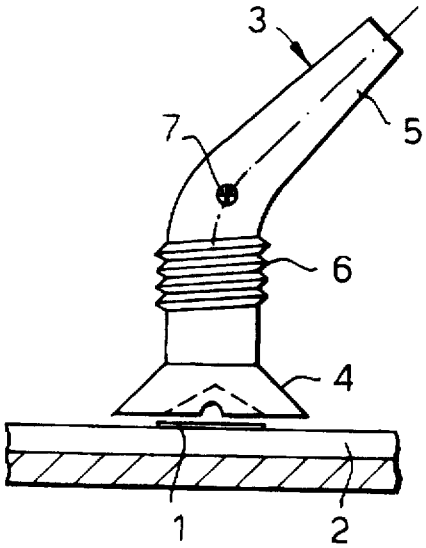
FIG. 5 shows diagrammatically a further form of antenna arrangement.

The gains of the steering beams, as fed from the off-axis guide rods, are necessarily optimised when the rod axes are parallel to the steering direction, with bent guide rods as shown in FIG. 5.

Where the apertured element is elliptical or rectangular the necessary illumination pattern can be generated with elliptical or rectangular section guide rods, which enable the antenna gain to be optimised and the side-lobes minimised for the two orthogonal beam-widths.

The antenna arrangement shown in FIG. 1(*a*) enables the substrate area for a required array of patch radiating elements 1 to be minimised, together with the size of the housing required and the overall cost. Where the arrangement is used to illuminate a prime-focus reflector such as a parabolic dish antenna, the smaller housing offers less obstruction to reflected radiation with a consequent improvement in gain and reduction in side-lobes. The smaller antenna arrangement can also be used to advantage with Cassegrain and Gregorian multiple reflector antennae.

Where the antenna arrangement of FIG. 1(*a*) is used without further elements, either the gain with a given array of radiating patches can be improved by utilising guide rods 3 of the form described or the size of the array can be reduced for a given gain.

The internal diameter of the tubular section 4 at its lower end should be approximately equal to the equivalent diameter of a patch 1. If this internal diameter is too large the coupling between the patch 1 and the guide rod 3 will be too low. If the internal diameter is smaller than the equivalent patch diameter greater coupling will result but the resonant frequency of the patch will be reduced.

The outer diameter of the section 5, and for that matter of the section 4, should not be so large as to excite higher order modes.

The half-power beam-width which may be expected is proportional to the square root of the ratio of the operating wavelength and the length L of the guide rod 3.

I claim:

1. An antenna arrangement comprising a dielectric rod, and a radiating element coupled to said dielectric rod by means of a tapered tubular dielectric guide.

2. An antenna arrangement in accordance with claim 1 wherein the dielectric guide is formed integrally with the dielectric rod.

3. An antenna arrangement in accordance with claim 2 wherein the integrally formed dielectric guide and dielectric rod is arranged to be supported over the radiating element by means of a screen panel.

4. An antenna arrangement in accordance with claim 3 wherein the screen panel is constructed as a microwave absorbing panel.

5. An antenna arrangement in accordance with claim 3 wherein the screen panel comprises two quarter wavelength thick dielectric panels separated by a thin conducting sheet.

6. An antenna arrangement in accordance with claim 3 wherein the screen panel incorporates a half-wave radio-transparent radome panel centered around the integrally formed dielectric guide and dielectric rod.

7. An antenna arrangement in accordance with claim 3 wherein the screen panel is formed as a meniscus lens.

8. An antenna arrangement in accordance with claim 3 wherein the screen panel is spaced from the radiating element by half a wavelength at the center frequency of operation.

9. An antenna arrangement in accordance with claim 3 wherein the integrally formed dielectric guide and dielectric rod is provided along part of its length with an external thread by means of which it is adjustably located with respect to the screen panel such that a gap between a tubular guide end of the integrally formed dielectric guide and dielectric rod and the radiating element is adjusted.

10. An antenna arrangement in accordance with claim 9 wherein the gap is of the order of 3% of a wavelength at the center frequency of operation.

11. An antenna arrangement in accordance with claim 3 wherein the screen panel comprises dual dielectric panels separated by a half wavelength and each less than a half wavelength thick.

12. An antenna arrangement in accordance with claim 1 wherein the radiating element is a patch radiating element.

13. An antenna arrangement in accordance with claim 1 wherein the radiating element is a slot radiating element.

14. An antenna arrangement utilizing dielectric rods, comprising an array of patch radiating elements formed on a common substrate, each patch radiating element being coupled to a respective dielectric rod by means of a respective tapered tubular dielectric guide.

15. An antenna arrangement in accordance with claim 14 wherein each dielectric guide is formed integrally with its respective dielectric rod.

* * * * *